US005143332A

United States Patent [19]

Camilleri

[11] Patent Number: 5,143,332

[45] Date of Patent: Sep. 1, 1992

[54] SLIDING RECEPTACLE FOR SUPPORTING AN OPENED BAG AND STORING FOLDED BAGS

[75] Inventor: Charles Camilleri, St. Louis, Mo.

[73] Assignee: Lee/Rowan Company, St. Louis, Mo.

[21] Appl. No.: 683,843

[22] Filed: Apr. 11, 1991

[51] Int. Cl.[5] ..... A47B 77/00

[52] U.S. Cl. ..... 248/95; 312/211; 312/323

[58] Field of Search ..... 248/95-101, 248/128; 312/250, 201, 211, 212, 341.1, 342, 323

[56] References Cited

U.S. PATENT DOCUMENTS

| | | | |
|---|---|---|---|
| 664,755 | 12/1900 | Hunter | 312/323 |
| 1,816,213 | 7/1931 | Duke | 312/323 X |
| 2,005,938 | 6/1935 | Graves | 248/128 |
| 2,796,309 | 6/1957 | Taylor | 248/95 X |
| 3,679,274 | 7/1972 | Nance | 312/344 H |
| 3,922,096 | 11/1975 | Schneider | 312/211 |
| 3,973,814 | 8/1976 | Entrikin | 312/341.1 X |
| 4,723,743 | 2/1988 | Jenkins | 248/97 |

*Primary Examiner*—Alvin C. Chin-Shue

*Attorney, Agent, or Firm*—Rogers, Howell & Haferkamp

[57] ABSTRACT

A sliding receptacle is provided that is comprised of a receptacle container for supporting an opened bag, and a platform extension and looped band for retaining one or more folded bags. The sliding receptacle is also provided with a pair of laterally spaced and longitudinally extending rails secured to its underside, and a pair of tracks that engage the rails in sliding engagement. The tracks are mounted in a laterally spaced, longitudinally extending disposition on a flat horizontal base surface and the receptacle is mounted for sliding fore and aft movement on the tracks. The receptacle rails are provided with fore and aft stop abutments that limit the extent to which the receptacle may slide over the tracks, and the receptacle rails are provided with slots dimensioned to enable the rails and the receptacle to be disengaged from the tracks by elevating and leveling the rails and receptacle relative to the tracks, and sliding the rails and receptacle forward over the tracks.

19 Claims, 3 Drawing Sheets 12
122
128
118
26
154
24
106
107
126
86
76
54
96
112
84
14
6
6
116
18
2
2
16
107
96
96
176
98
102
22
116
94
88
88
96
112
74
104
107
66
172
52
152
174

FIG. 7.
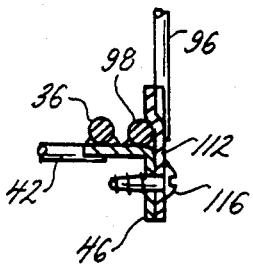
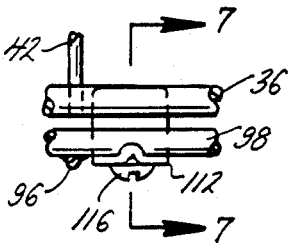
FIG. 6.
FIG. 2.
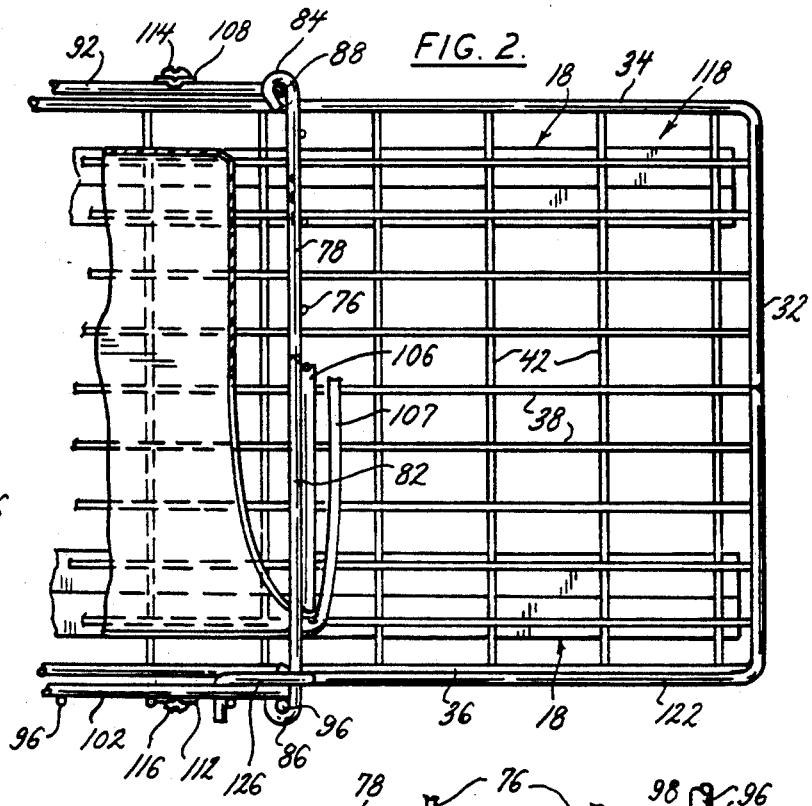
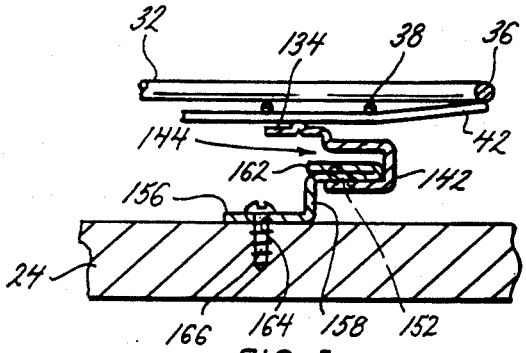
FIG. 5.
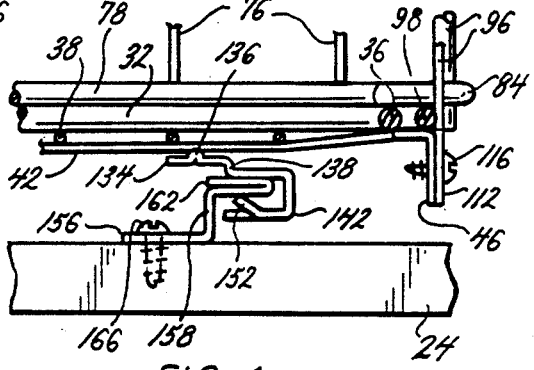
FIG. 4.
FIG. 3.
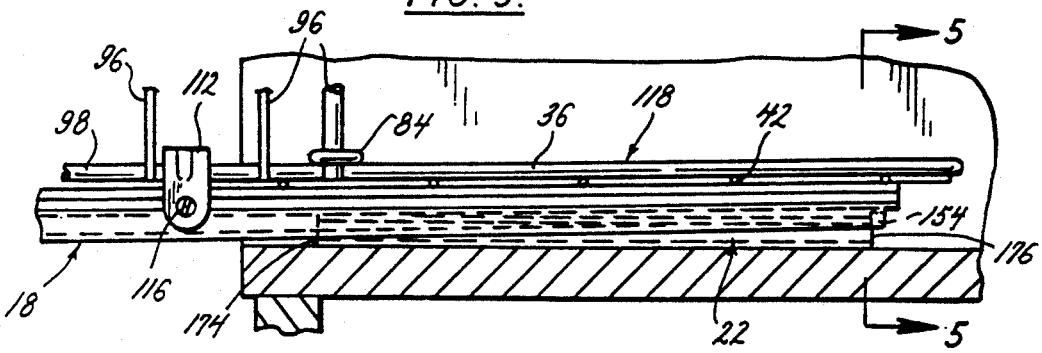

SLIDING RECEPTACLE FOR SUPPORTING AN OPENED BAG AND STORING FOLDED BAGS

BACKGROUND OF THE INVENTION (1) Field of the invention

The present invention relates to a receptacle that both supports an opened paper or plastic bag and stores folded bags. In particular, the present invention relates to a receptacle that both supports an opened paper or plastic bag and stores one or more folded bags, and is mounted for sliding fore and aft movement on a base. The apparatus of the invention is generally comprised of only three separate component parts that are inexpensive to manufacture and are easily assembled to a flat horizontal base surface.

(2) Description of the Related Art

It has long been common practice to reuse the carryout paper and plastic bags given out at grocery stores and other types of stores. These types of bags have been used in the home and the workplace for a variety of purposes. Very often, the bags are saved and are reused in the home or workplace as disposable trash bags. The bags are used as liners in trash cans and wastepaper baskets and are disposed of when filled with trash or wastepaper.

The use of trash cans and wastepaper baskets, and the use of store carryout bags as the liners for the cans and baskets, is often inconvenient. The cans or baskets take up floor space in the home or workspace and it is often necessary to store the bags in one general area of the home or workplace that is separated from the trash cans or wastepaper baskets. This necessitates going to the area of the home or work place where the carryout bags are stored to retrieve a bag for the trash can or waste basket each time the can or basket is emptied.

The present invention overcomes the inconveniences associated with prior art trash cans and wastepaper baskets, and the inconveniences associated with employing carryout shopping bags as liners for trash cans and wastepaper baskets. The present invention provides a sliding receptacle that can be mounted out-of-the-way beneath a countertop or inside a cabinet enclosure, where the apparatus both supports opened bags in the same manner as a trash can or wastepaper basket, and stores one or more folded bags.

The apparatus of the invention includes a platform that is mounted for sliding fore and aft movement on a horizontal base beneath a countertop or inside a cabinet enclosure. A basket container extends upward from the platform and provides support for opened paper bags placed inside the basket, or suspends opened plastic bags from a top edge of the basket. A U-shaped band extends from a side of the basket over a portion of the platform. The U-shaped band enables placing folded bags inside the band and on top of the platform to store the folded bags adjacent the basket container.

SUMMARY OF THE INVENTION

The present invention relates to a sliding receptacle for supporting an opened bag and storing folded bags. The present invention is generally comprised of a platform having a support basket container secured over a portion of the top surface of the platform, a pair of rails secured to an underside of the platform, and a pair of tracks that are secured to a base and support the platform for sliding movement fore and aft over the base. The component parts of the invention are inexpensive to manufacture and are easily assembled to a horizontal base surface. The simplified construction of the sliding support and storage receptacle enables any lay person to mount the pair of tracks to a horizontal base surface inside a cabinet or below a countertop, and then assemble the platform to the tracks for fore and aft sliding movement of the platform on the base surface.

The platform is generally a rectangular wire mesh platform comprised of first and second pluralities of crisscrossing wires. The bag supporting container provided on the platform is generally comprised of four side walls connected end-to-end and arranged in a box-like configuration. Each of the four side walls are constructed of pluralities of spaced parallel wires. The end-to-end connections of the four side walls enable adjacent side walls to pivot relative to each other. This enables the four side walls t be folded flat when not secured to the top surface of the platform, and also enables the component parts of the sliding receptacle to be packed in a compact package for storage and shipment. When secured over a portion of the platform top surface, the four side walls and the platform top surface form a box-like basket container having an open top. The four side walls provide support for a paper shopping bag placed inside the side walls and opened to its three-dimensional configuration providing access to the bag interior.

A pair of wire handles are provided on the top edges of opposed side walls of the basket container. The handles are used to manually carry the sliding receptacle. In addition, the handles are used to suspend a plastic shopping bag inside the container by looping the handles of the plastic shopping bag over the container handles, thereby causing the container handles to suspend the bag inside the container.

A portion of the platform, herein referred to as the platform extension, extends longitudinally out from beneath the container side walls and is not surrounded by the side walls. A U-shaped wire projects longitudinally out from the top edge of one of the container side walls over the platform extension. The U-shaped wire has opposite ends that are releasably attached over the top edge of the side wall, and the wire forms a looped band that extends out above the extension substantially parallel to the platform. The looped band and platform extension together provide a storage area for shopping bags that have been folded flat. One or more folded bags may be inserted inside the looped band and placed on the top surface of the platform extension. There the folded bags will be held in place by the looped band. This enables several folded bags to be stored adjacent the basket container ready for use when needed.

The pair of rails secured to the underside of the platform are laterally spaced and extend parallel and longitudinally across the underside of the platform. Each of the rails has a generally C-shaped cross section. The interior of the C-shape forms a slot in the rails that extends along their entire longitudinal length.

The pair of tracks are to be secured to a horizontal base surface on which the sliding receptacle is desired to be mounted. Each of the tracks is formed with a flange that is elevated slightly above the base surface on which the tracks are mounted. The flanges extend the entire longitudinal length of the tracks. Each of the track flanges is dimensioned to be received in one of the slots in the pair of rails secured to the underside of the platform. The engagement of the flanges in the rail slots provides a sliding connection between the rails and tracks that enables sliding movement of the receptacle longitudinally fore and aft over the base surface.

The pair of rails secured to the platform bottom are slightly more than three times longer than the pair of tracks secured to the horizontal base surface. Fore and aft stops are provided at the opposite ends of each rail. The opposite ends of the tracks, secured to the horizontal base surface, engage the fore and aft rail stops at the furthest extent of the respective backward and forward sliding movement of the rails over the tracks. Engagement of the track ends with the fore and aft stops of the rails prevents the sliding receptacle from sliding further backward or forward over the tracks.

The fore and aft stops on the opposite ends of the rails extend upward into lower portions of the rail slots. The rail slots have a vertical width dimensioned large enough to allow some relative vertical movement between the pair of rails and the pair of tracks. By pulling the sliding receptacle forward the forward ends of the receptacle and rails pivot downward slightly on the tracks. The downward pivoting movement of the rail forward ends causes the rail aft stop abutments to move upward relative to the tracks and engage the aft ends of the tracks as the rails are moved further forward. In a similar manner, moving the sliding receptacle backward over the tracks causes the rearward ends of the receptacle and rails to pivot downward slightly relative to the tracks. This pivoting movement causes the rail fore stop abutments to move upward. The upward movement of the rail fore stop abutments causes them to engage the fore ends of the tracks as the rails are moved backward and stops any further backward movement of the sliding receptacle.

By holding the receptacle and rails level relative to the pair of tracks, the fore and aft stop abutments of the rails are prevented from engaging the fore and aft ends of the pair of tracks. With the rails held level relative to the tracks as the receptacle is moved forward, the receptacle can be completely removed from the pair of tracks. The pair of rails are reengaged in sliding engagement with the pair of tracks in a similar manner, by holding the rails level relative to the pair of tracks.

BRIEF DESCRIPTION OF THE DRAWINGS

Further objects and features of the present invention are revealed in the following detailed description of the preferred embodiment of the invention and in the drawing figures wherein:

FIG. 2 is a segmented plan view, partially in section, of the receptacle of the invention taken along the line 2—2 of FIG. 1;

FIG. 3 is a segmented elevation view of the rearward end of a rail and a track of the present invention;

FIG. 4 is a front elevation view in section of a rail and track of the invention taken along the line 4—4 of FIG. 3;

FIG. 5 is a front elevation view in section of a rail and track of the present invention taken along the line 5—5 of FIG. 3;

FIG. 6 is a segmented plan view of a connection between the receptacle container and platform of the invention taken along the line 6—6 of FIG. 1;

FIG. 7 is a front elevation view of a connection between the receptacle container and platform of the invention taken along the line 7—7 of FIG. 6;

DESCRIPTION OF THE PREFERRED EMBODIMENT

Figure 1:
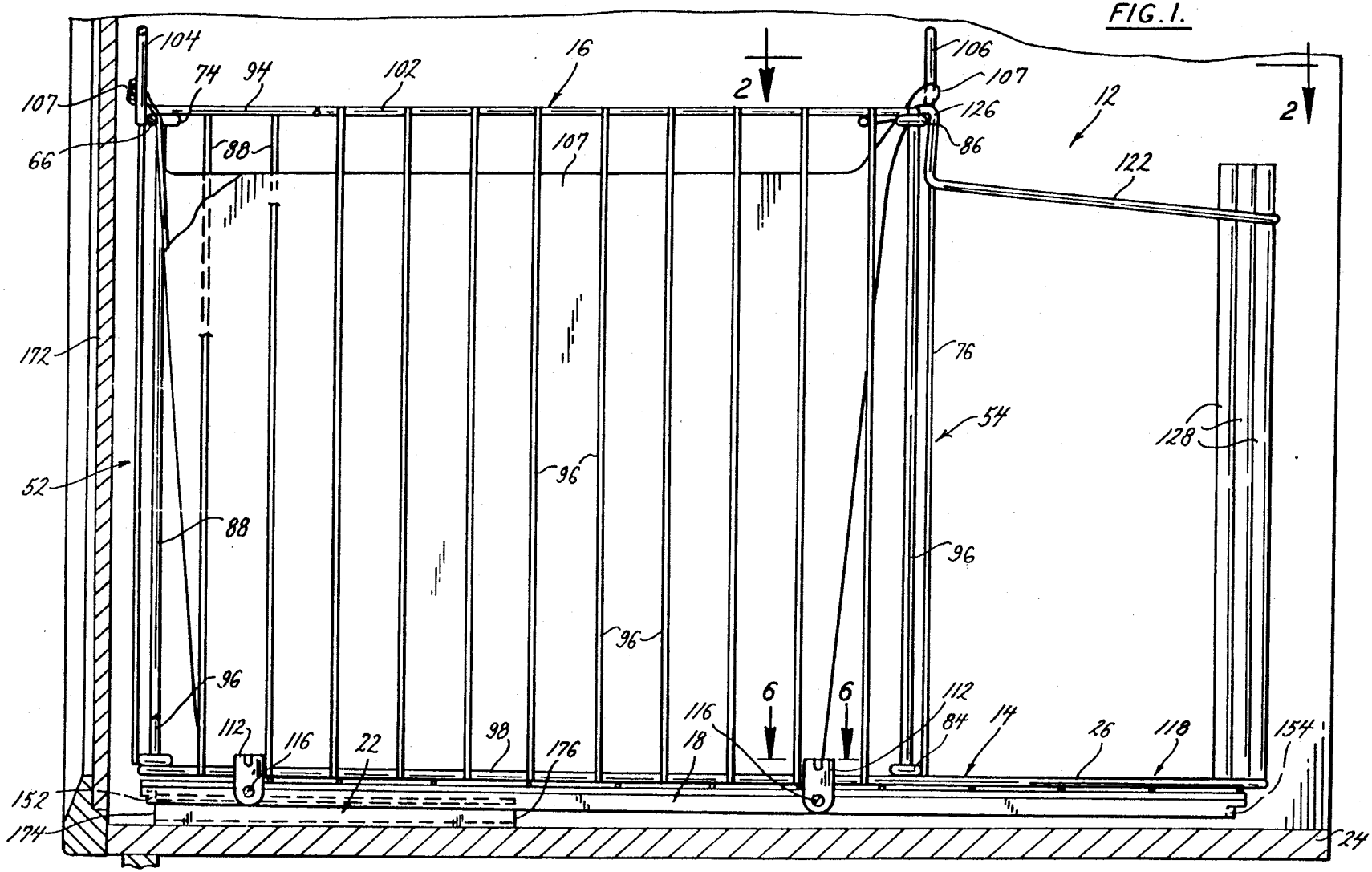
FIG. 1 is a side elevation view of the sliding bag support and storage receptacle of the present invention mounted in a cabinet enclosure.

The sliding receptacle 10 of the present invention is shown in FIG. 1 of the drawing figures. The receptacle is primarily intended for supporting an opened shopping bag of the type given out at grocery stores and other types of stores for carrying customer's purchases, and for storing a plurality of folded bags of this type. However, it should be understood that the sliding receptacle 12 could be employed for a variety of purposes other than that to be disclosed.

The sliding receptacle 12 of the present invention is generally comprised of a platform 14 having a support basket container 16 secured to a top surface of the platform. A pair of rails 18 are secured to an underside of the platform, and a pair of tracks 22 are to be secured to a horizontal base surface 24 to support the platform for sliding movement fore and aft over the base surface.

The platform 14 is generally a rectangular wire mesh platform. The platform includes a rectangular peripheral wire loop 26 comprised of front and back sections 28, 32 and left and right sections 34, 36 as viewed in FIG. 8. A first plurality of parallel, laterally spaced wires 38 extend longitudinally across the platform between the front and back sections 28, 32. A second plurality of parallel, longitudinally spaced wires 42 extend laterally across the platform between the left an right sections 34, 36 of the platform loop 26. The first and second pluralities of wires 38, 42 crisscross each other and are secured together by welds. The opposite ends of the wires are secured by welds to the wire loop 26 to form the receptacle platform 14.

Two pairs of connection tabs 44, 46 are secured to the underside of the left and right sections 34, 36 of the platform loop. The connection tabs 44, 46 of each pair are longitudinally spaced along the left and right loop sections. The tabs are employed in assembling the support container 16 to the platform in a manner to be explained.

Figures 8, 9:
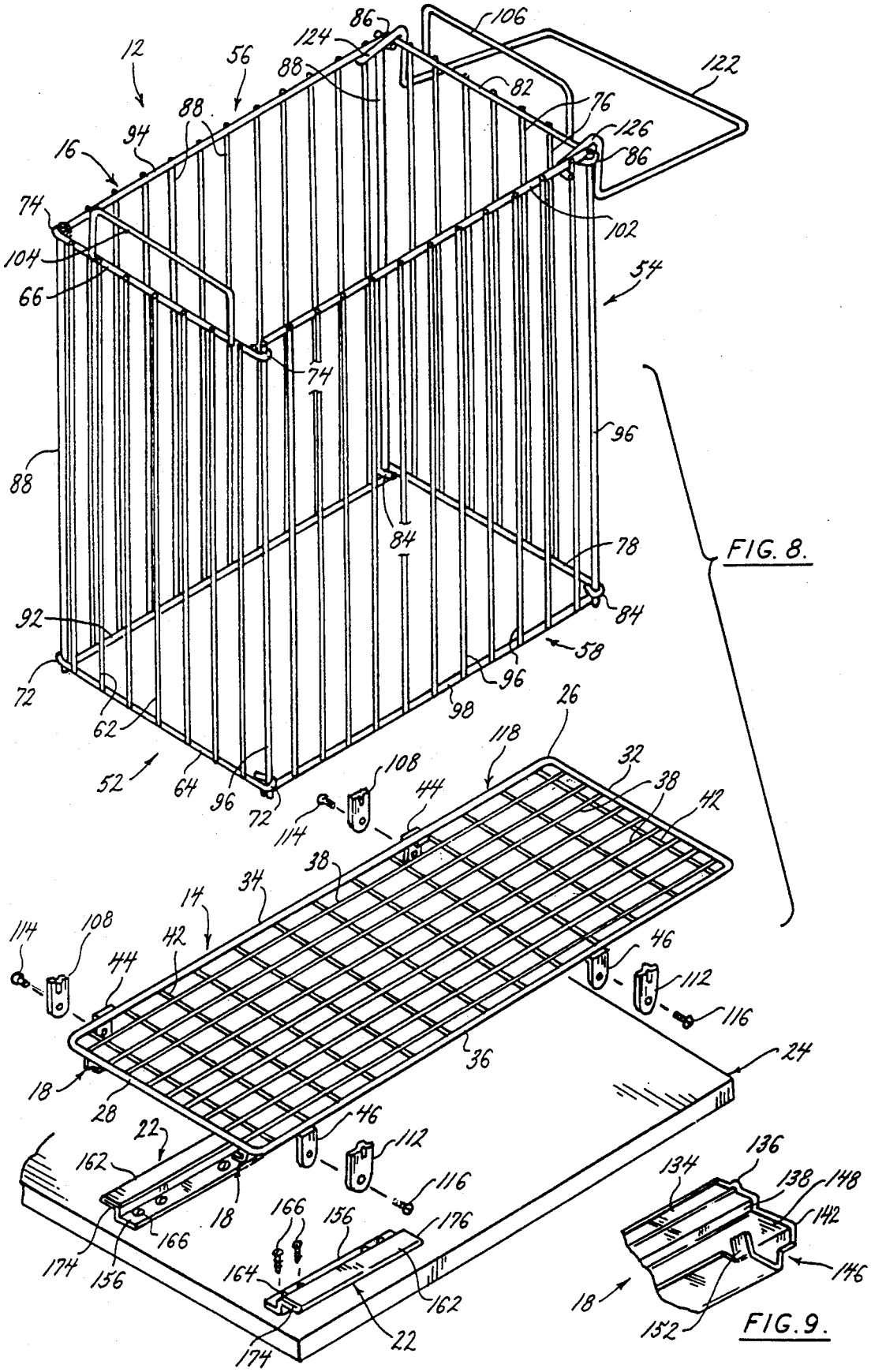
FIG. 8 is an exploded perspective view of the component parts of the present invention.
FIG. 9 is a segmented perspective view showing the detail at one end of a rail of the present invention.

The support basket container 16 is comprised of a front and back side wall 52, 54 and a left and right side wall 56, 58 as viewed in FIG. 8. The front side wall 52 is comprised of a plurality of parallel, laterally spaced vertical wires 62. The vertical wires 62 have a first horizontal wire 64 secured across their bottom ends and a second horizontal wire 66 secured across their top ends. The first, or bottom horizontal wire 62 as viewed in FIG. 8, is provided with bent loops 72 at its opposite ends. The second 66, or top horizontal wire as viewed in FIG. 8, also has bent loops 74 at its opposite ends. The back side wall 54 is also constructed from a plurality of parallel, laterally spaced vertical wires 76. The wires 76 are secured at their opposite bottom and top ends to a bottom horizontal wire 78 and a top horizontal wire 82, respectively. The opposite left and right hand ends of the bottom horizontal wire 78 are bent to form loops 84, and the opposite left and right hand ends of the top horizontal wire 82 are bent to form loops 86. Like the front and back walls, the left side wall 56 is formed from a plurality of parallel, laterally spaced vertical wires 88. The wires 88 are secured at their bottom ends by a bottom horizontal wire 92, and are secured at their top ends by a top horizontal wire 94. The right side wall 58 is also formed from a plurality of parallel, laterally spaced vertical wires 96. The wires are connected along their bottom ends to a bottom horizontal wire 98, and are connected along their top ends to a top horizontal wire 102.

The bent loops 72, 74 at the left sides of the bottom and top horizontal wires 64, 66 of the front side wall 52 engage around one of the plurality of vertical wires 88 of the left side wall 56 at the extreme left end of the left side wall as viewed in FIG. 8. Forming the front wall bends 72, 74 around the vertical wire 88 of the left side wall 56 provides a hinged or pivoting connection between the front and left side walls 52, 56. The bend loops 84, 86 at the left ends of the bottom and top horizontal wires 78, 82 of the back wall 54 engage around a vertical wire 88 of the left side wall 56 at the extreme right end of the side wall as viewed in FIG. 8. The engagement of the bends 84, 86 around the vertical wire 88 forms a hinged or pivoting connection between the back wall 54 and the left side wall 56. The bends 72, 74 at the right ends of the bottom and top horizontal wires 64, 66 of the front wall 52 engage around one of the vertical wires 96 of the right side wall 58 at the extreme left end of the right side wall as viewed in FIG. 8. The engagement of the bends 72, 74 around the vertical wire 96 of the right side wall 58 forms a hinged or pivoting connection between the front wall 52 and the right side wall 58. The bends 84, 86 at the right end of the bottom and top horizontal wires 78, 82 of the back wall 58 engage around a vertical wire 96 at the extreme right hand end of the right side wall 58 as viewed in FIG. 8. The engagement of the bends 84, 86 around the vertical wire 96 of the right side wall 58 forms a hinged or pivoting connection between the back wall 54 and the right side wall 58. The hinged connections formed between the four side walls enable the side walls of the container 16 to be folded flat over each other and also enable the component parts of the sliding receptacle to be packed in a compact package for storage and shipment.

A pair of wire handles 104, 106 are secured to the top horizontal wire 66 of the front wall 52 and the top horizontal wire 82 of the back wall 54, respectively The handles are used in manually carrying the sliding receptacle. In addition, the handles are used to suspend a plastic shopping bag inside the container 16 as seen in FIGS. 1 and 2. The handles of the plastic shopping bag 107 are looped over the container handles 104, 106, thereby causing the container handles to suspend the bag inside the container.

Two pairs of connecting tabs 108, 112 are secured to the bottom horizontal wires 92, 98 of the container left and right side walls 56, 58, respectively. Each tab of the pair of tabs 108, 112 is spaced longitudinally at opposite ends of the bottom horizontal wires 92, 98 of the right and left side walls 56, 58. The longitudinal positioning of the tabs corresponds to the positioning of the connection tabs 44, 46 secured to the platform 14. Pairs of screws 114, 116 are provided with the pairs of tabs 108, 112 to attach the pairs of tabs 108, 112 secured to the container 16 to the pairs of tabs 44, 46 secured to the platform 14, and thereby attach the container 16 in position over a forward portion of the top surface of the platform The container side walls support an opened paper shopping bag on the container platform 14 in the same manner as trash can or wastepaper basket side walls.

As is best seen in FIG. 1, with the container 16 attached on a forward portion of the top surface of the platform 14, a rearward portion of the platform 118 extends longitudinally rearward out from beneath the rear wall 54 of the container 16. This rearward extension of the platform 118 not surrounded by the container side walls is used in storing folded bags in a manner to be explained.

A wire 122 having a general U-shape is releasably secured over the top horizontal wire 82 of the rear container wall 54. The wire 122 is bent in a rectangular U-shape and opposite left and right hand ends 124, 126 of the wire, as viewed in FIG. 8, are bent up and over the top horizontal wire 82 of the container rear wall 54. The opposite ends 124, 126 of the U-shaped wire are then bent outward underneath the upper horizontal wires 94, 102 of the left and right container side walls 56, 58 as viewed in FIG. 8. The bends provided in the opposite ends of the U-shaped wire 122 releasably engage the opposite ends of the wire over the top horizontal wire 82 of the rear wall 54 and under the top horizontal wires 94, 102 of the left and right side walls 56, 58. The U-shaped wire 122 is flexible, and the opposite ends 124, 126 can be flexed inward toward each other to disengage the U-shaped wire 122 from its connection to the container 16.

When attached to the top of the receptacle container 16, the U-shaped wire 122 projects longitudinally out from the top edge of the container rear wall 54 over the platform extension 118 that projects longitudinally out from beneath the container side walls. The wire 122 forms a looped band that extends out above the platform extension 118 substantially parallel to the platform 14. The looped band 122 and platform extension 118 together provide a storage area for paper shopping bags 128 that have been folded flat. One or more folded bags 128 may be inserted down inside the looped band 122 and placed on top of the platform extension 118. There the folded bags are held in place by the looped band 122. This structure enables several folded bags to be stored adjacent the basket container 16 ready for use when needed.

The pair of rails 18 secured to the underside of the receptacle platform 14 are substantially identical and are mirror images of each other. The rails 18 are spaced laterally under the container platform 14 and, as is best seen in FIG. 1, extend substantially the entire longitudinal length of the sliding receptacle 12. As is seen in FIGS. 4, 5 and 9, each rail 18 is formed with a substantially flat horizontal top surface 134 that extends the entire longitudinal length of the rail. A weld bead 136 (seen in FIG. 9) extends longitudinally across the middle of each rail top section 134. The weld bead 136 is secured by welds to the underside of the criss-crossing pluralities of wires 38, 42 that form the receptacle platform at each point where the weld bead 136 contacts one of the crisscrossing pluralities of wires. Each of the rails also includes a vertical section 138 that depends downward from a lateral edge of the top section 134. The vertical section also extends along the entire longitudinal length of the rail. At the bottom most edge of the vertical section 138, the rail is formed in a C-shaped section 142. The interior of the C-shaped section 142 forms a slot 144 in a lateral side of the rail that extends the entire longitudinal length of the rail.

As is best seen in FIG. 9, the lower half of the C-shaped section 142 is cut away at the opposite ends of the rails 18, leaving a small notch 146. The notches 146 expose a small portion of the interior surface 148 at the top of the rail C-shaped sections 142. The exposed interior surface 148 facilitates the mounting of the pair of rails 18 on the pair of tracks 22 as will be later explained.

Adjacent the notches 146 at the opposite ends of the rails 18, the bottoms of the rail C-shaped sections 142 are cut to form tabs. The tabs are bent upward into the slots 144 formed by the C-shaped sections 142. The tabs form fore and aft stop abutments 152, 154 at the opposite forward and rearward ends of the rails 18. The fore and aft stop abutments 152, 154 limit the sliding movement of the rails 18 over the tracks 22.

As seen in FIG. 1, the longitudinal length of the rails 18 is substantially the same longitudinal length of the receptacle platform 14. This enables more than one-half of the sliding receptacle 12 to be extended beyond the forward most ends of the tracks 22 when the receptacle is moved to its furthest extent forward on the tracks. The pair of rails 18 are secured to the underside of the receptacle platform 14 in a laterally spaced relation. The rails extend parallel and longitudinally across the bottom of the receptacle platform with the slots 144 of the rails facing each other. Alternatively, the rails could be secured to the bottom of the receptacle platform with the slots 144 facing away from each other (not shown). Of course, the positions of the tracks 22 would also have to be altered so that they would still engage properly with the rails in a manner to be described.

The pair of tracks 22 are also substantially identical to each other. One track 22 of the pair of tracks is shown in FIGS. 4 and 5 inserted into the slot 144 of one rail 18 of the pair of rails. As seen in FIGS. 4 and 5, each track is formed with a bottom horizontal section 156 that extends the entire longitudinal length of the track. A vertical section 158 extends upward from a lateral side edge of the bottom section 156. The vertical section also extends the entire longitudinal length of the track. A flange section 162 is formed along the top most edge of the vertical section 158. The flange section is formed by folding the top half of the track flange over on itself as seen in FIGS. 4 and 5. The flange section 162 projects laterally from the top edge of the vertical section 158 and extends the entire longitudinal length of the track. Pluralities of holes 164 are provided through the bottom horizontal sections 156 of the tracks. The holes receive threaded fasteners such as wood screws 166 or other equivalent types of fasteners to secure the pair of tracks 22 to the flat horizontal base surface 24. The longitudinal length of the tracks is about one third the length of the rails to allow limited pivoting movement of the rails on the tracks as will be explained.

The sliding receptacle 12 of the present invention is mounted to a flat horizontal base surface 24 with the component parts of the invention relatively positioned as shown in drawing FIG. 1. The drawing figure shows the assembly of the invention mounted inside a cabinet enclosure behind a door 172 of the cabinet. The apparatus of the invention is shown in this environment for illustrative purposes only, and it should be understood that the operative environment of the invention describe is not intended to be limiting.

Mounting the sliding receptacle 12 of the invention on a base surface 24 can be done by using a paper template (provided with the assembly) to secure the pair of tracks 22 in a desired position on the surface with threaded fasteners. When both tracks have been secured to the base surface 24 by the threaded fasteners, the sliding receptacle 12 is ready for sliding fore and aft movement over the pair of tracks 22 between its rearward most position shown in FIG. 1, and its forward most position shown in FIG. 3.

To attach the sliding receptacle 12 for sliding movement on the pair of tracks 22, the receptacle is held level relative to the tracks as the pair of rails 18 are attached on the forward ends 174 of the tracks. The notches 146 cut out from the rearward ends of the pair of rails 18 enable the exposed interior surfaces 148 of the rail C-shaped sections 142 to be first placed on top of the forward most ends of the track horizontal flange sections 162. With the interior surfaces 148 of the rail C-shaped sections 142 resting on top of the track flanges 162, and with the receptacle 12 and attached rails 18 held level relative to the tracks 22, the receptacle assembly is pushed backward so that the C-shaped rail sections 142 slide over the track flanges 162. With the receptacle 12 and attached rails 18 held level, the aft abutments 154 on the rails 18 will pass underneath the forward most ends 174 of the tracks 22 as the receptacle slides backward over the tracks (see FIG. 4).

Referring to drawing FIGS. 4 and 5, it can be seen that the vertical dimensions of the rail slots 144 enable limited vertical movement of the receptacle 12 and rails 18 relative to the tracks 22. The vertical dimensions of the rail slots 144 also enable the receptacle 12 and rails 18 to pivot slightly relative to the pair of tracks 22 as the receptacle is pulled out or pushed back on the tracks.

FIG. 3 shows the rearward end of the receptacle platform 118 when the receptacle has been pulled out to its furthest extent on the pair of tracks 22. As the receptacle is being pulled forward on the tracks, the weight of the receptacle and any objects contained in the receptacle container cause the forward end, or left end of the receptacle as viewed in FIG. 3, to move slightly downward over the forward end 174 of the tracks. The downward movement of the platform forward end causes the rearward or right hand end of the platform 14 and rails 18 to pivot about the forward end 174 of tracks and move slightly upward relative to the tracks 22. The upward movement of the rails is limited by the engagement of the rail C-shaped sections 142 with the underside of the track flanges. The upward movement of the rearward end of the receptacle platform 14 and rails 18 causes the rail aft stop abutments 154 to move upward relative to the tracks 22. This causes the aft stop abutments 154 to engage against the aft ends 176 of the tracks 22 as the receptacle is pulled forward (see FIGS. 3 and 5).

This same pivoting movement of the receptacle platform 14 and rails 18 on the pair of tracks 22 occurs when the receptacle is pushed backward over the tracks. As the platform and rails are pushed backward over the pair of tracks 22, the weight of the receptacle container 16, the platform extension 118, and any objects contained in the receptacle container or stored on the platform extension cause the rearward end, or right hand end of the receptacle platform 14 as viewed in FIG. 1, to move slightly downward over the aft ends 176 of the tracks. The downward movement of the rearward end of the receptacle platform 14 and rails 18 causes the receptacle to pivot slightly on the aft ends 176 of the pair of tracks 22. The pivoting movement of the receptacle causes the forward end, or left hand end as viewed in FIG. 1, of the receptacle and rails to move slightly upward. Again, the upward movement of the rails is limited by the engagement of the C-shaped sections with the underside of the track flanges. The upward movement causes the fore stop abutments 152 of the rails 18 to move upward relative to the pair of tracks 22 and engage against the fore ends 174 of the tracks 22 to stop the rearward sliding movement of the receptacle over the tracks.

To remove the receptacle 12 from the pair of tracks 22, the receptacle platform 14 is held level relative to the pair of tracks 22 as it is moved forward over the tracks. This prevents the pivoting movement of the platform 14 and rails 18 relative to the tracks 22, and also prevents the movement of the rail aft stop abutments 154 upward where they would engage against the aft ends 176 of the tracks. Holding the receptacle platform 14 and rails 18 level on the pair of tracks 22 causes the rail aft stops 154 to slide underneath the aft ends 176 of the rails 22, thereby enabling removal of the sliding receptacle from the pair of tracks 22.

Although a preferred embodiment of the invention has been described and shown in the drawing figures wit the slots 144 of the rail C-shaped sections facing inward toward each other, and the flanges 162 of the pair of tracks facing away from each other, it should be understood that the relative positions of these component parts of the invention could be reversed without effecting the operation of the invention. For example, the pair of rails 18 could be mounted to the underside of the receptacle platform 14 with the C-shaped sections of the rails facing away from each other. To accommodate this positioning of the rails, the pair of tracks 22 would then be mounted to the horizontal base surface 24 with the flanges 162 of the tracks positioned facing toward each other and engaging in the opposite facing slots of the pair of rails.

While the present invention has been described by reference to a specific embodiment, it should be understood that modifications and variations of the invention may be constructed without departing from the scope of the invention defined in the following claims.

What is claimed is:

1. A sliding support and storage apparatus for bags, the apparatus being slidable longitudinally fore and aft relative to a base, the apparatus comprising:

receptacle means including a first means for supporting an opened bag on the receptacle means, and a second means for storing at least one folded bag on the receptacle means; and support means for supporting the receptacle means on a base, the support means includes a first sliding support means and a second sliding support means, the first sliding support means is secured to an underside of the receptacle means and the second sliding support means is securable to the base to keep stationary relative to the base, the first sliding support means engages the second sliding support means secured stationary to the base to mount the first sliding support means for sliding movement on the second sliding support means and thereby mount the receptacle means for sliding movement on the base, the first sliding support means engages the second sliding support means secured stationary to the base to mount the first sliding support means for pivoting movement on the second sliding support means and relative to the second sliding support means, and thereby mount the receptacle means for pivoting movement relative to the base;

the first sliding support means includes at least one rail secured to the receptacle means, the rail extends longitudinally and has a lateral side, and the second sliding support means includes at least one track securable to the base, the track engages the lateral side of the rail to mount the rail for sliding movement on the track; and, the rail has opposite fore and aft ends and has fore and aft stops secured to the fore and aft rail ends, respectively; and, the track has opposite fore and aft ends, the fore stop of the rail engages the fore end of the track to stop rearward sliding movement of the rail on the track and the aft stop of the rail engages the aft end of the track to stop forward sliding movement of the rail on the track.

2. The apparatus of claim 2, wherein:

the rail is formed with a slot in its lateral side and the track is formed with a laterally extending flange, the flange engages in the slot to mount the rail for sliding movement on the track.

3. The apparatus of claim 1, wherein:

dimensions of the slot in the rail cause the fore end of the rail to move in a downward direction and the aft end of the rail to move in an upward direction as the rail slides forward on the track, and the upward movement of the rail aft end positions the rail aft stop for engagement with the track aft end.

4. The apparatus of claim 3, wherein:

the rail is removable from the track by preventing the fore end of the rail from moving downward as the rail slides forward on the track.

5. The apparatus of claim 1, wherein:

the first sliding support means includes a pair of separate, laterally spaced rails, each rail having a slot formed therein, and the second sliding support means includes a pair of separate tracks, each track having a flange formed thereon that is engagable in a rail slot to mount the pair of rails for sliding movement on the pair of tracks.

6. The apparatus of claim 5, wherein:

the first means for supporting a opened bag includes at least one side wall secured to the receptacle means, the side wall extending in an upward direction from the receptacle means to a top edge of the side wall.

7. The apparatus of claim 6, wherein:

the side wall forms a container on the receptacle means and the top edge of the side wall forms an opening of the container providing access to an interior of the container, the side wall provides support for opened bags placed inside the container on the receptacle means and the top edge of the side wall provides support for opened bags placed inside the container and suspended from the top edge.

8. The apparatus of claim 6, wherein:

the second means for storing at least one folded bag on the receptacle means includes a band that projects from the side wall over the receptacle means enabling placement of a folded bag inside the band and on the receptacle means.

9. The apparatus of claim 8, wherein:

the band is formed in a general U-shape and has opposite ends that are secured to the side wall and support the band extending longitudinally over the receptacle means.

10. A sliding support and storage apparatus for bags, the apparatus being slidable longitudinally fore and aft relative to a base, the apparatus comprising:

receptacle means including a first means for supporting an opened bag on the receptacle means, and a second means for storing at least one folded bag on the receptacle means; and support means for supporting the receptacle means on a base, the support means includes a first sliding support means and a second sliding support means, the first sliding support means is secured to an underside of the receptacle means and the second sliding support means is securable to the base to keep stationary relative to the base, the first sliding support means engages the second sliding support means secured stationary to the base to mount the first sliding support means for sliding movement on the second sliding support means and thereby mount the receptacle means for sliding movement on the base, and the first sliding support means engages the second sliding support means secured stationary to the base to mount the first sliding support means for pivoting movement on the second sliding support means and relative to the second sliding support means, and thereby mount the receptacle means for pivoting movement relative to the base;

the first means for supporting an opened bag includes at least one side wall secured to the receptacle means, the side wall extending in an upward direction from the receptacle means to a top edge of the side wall;

the second means for storing at least one folded bag on the receptacle means includes a band that projects from the side wall over the receptacle means enabling placement of a folded bag inside the band and on the receptacle means;

the band is formed in a general U-shape and has opposite ends that are secured to the side wall and support the band extending longitudinally over the receptacle means; and, the opposite ends of the band are releasably secured to the side wall enabling the band to be removed from the side wall.

11. The apparatus of claim 10, wherein:

the receptacle means includes a platform, the side wall is secured to the platform, and the ends of the band extend over the top edge of the side wall and are releasably secured to the side wall to support the band over the platform.

12. A sliding support and storage apparatus for disposable bags, the apparatus being mountable on a base and slidable longitudinally fore and aft relative to the base, the apparatus comprising:

receptacle means including a first means for supporting an opened bag, and a second means, different from the first means, for storing at least one folded bag;

first sliding support means secured to an underside of the receptacle means and extending longitudinally a first distance beneath the receptacle means;

second sliding support means to be secured to the base to keep stationary relative to the base and extending longitudinally a second distance over the base, the second sliding support means engaging the first sliding support means to mount the first sliding support means for sliding movement on the second sliding support means and thereby mount the receptacle means for sliding movement on the base, and the second sliding support means engaging the first sliding support means to mount the first sliding support means for pivoting movement on the second sliding support means and thereby mount the receptacle means for pivoting movement on the base;

the second sliding support means overlaps and engages a lateral side of the first sliding support means to mount the first sliding support means for sliding movement on the second sliding support means;

the first sliding support means includes at least one rail secured to the underside of the receptacle means, the rail having a longitudinally extending slot formed therein;

the second sliding support means includes at least one track to be secured to the base, the track having a laterally extending flange that engages in the slot of the rail to mount the rail and the receptacle means for sliding movement on the track;

the rail has opposite fore and aft ends and fore and aft stops secured on the fore and aft ends of the rail, respectively; and the track has opposite fore and aft ends, the fore stop of the rail engages the fore end of the track to stop rearward sliding movement of the rail on the track, and the aft stop of the rail engages the aft end of the track to stop forward sliding movement of the rail on the track.

13. The apparatus of claim 12, wherein:

the first distance is longer than the second distance.

14. The apparatus of claim 12, wherein:

the first sliding support means includes a pair of separate, laterally spaced rails, each rail having a longitudinally extending slot therein; and the second sliding support means includes a pair of separate tracks, each track having a flange thereon that is engagable in a slot of a rail to mount the pair of rails for sliding movement on the pair of tracks.

15. The apparatus of claim 12, wherein:

the receptacle means includes a platform, the first sliding support means is secured to an underside of the platform, the first means for supporting an opened bag is secured on the platform and the second means for storing at least one folded bag is secured to the first means.

16. The apparatus of claim 15, wherein:

the second means is releasable secured to the first means.

17. The apparatus of claim 15, wherein:

the first means is a container secured to the platform, the container having a top opening providing access to an interior of the container, and the second means is a band secured to the container, the band extending in a loop away from the container and out over a portion of the platform.

18. The apparatus of claim 17, wherein:

the band is releasably secured to the container and is removable from the container.

19. A sliding support and storage apparatus for bags, the apparatus being slidable longitudinally fore and aft relative to a base, the apparatus comprising:

receptacle means including a first means for supporting an opened bag on the receptacle means, and a second means for storing at least one folded bag on the receptacle means; and support means for supporting the receptacle means on a base, the support means includes a first sliding support means and a second sliding support means, the first sliding support means is secured to an underside of the receptacle means and the second sliding support means is securable to the base to keep stationary relative to the base, the first sliding support means engages the second sliding support means secured stationary to the base to mount the first sliding support means for sliding movement on the second sliding support means and thereby mount the receptacle means for sliding movement on the base, and the first sliding support means engages the second sliding support means secured stationary to the base to mount the first sliding support means for pivoting movement on the second sliding support means and relative to the second sliding support means, and thereby mount the receptacle means for pivoting movement relative to the base;

the first sliding support means includes at least one rail secured to the receptacle means, the rail having a lateral side;

the second sliding support means includes at least one track securable to the base to keep stationary relative to the base, the rail is formed with a slot in its lateral side and the track is formed with a laterally extending flange, the flange engages in the slot to mount the rail for sliding movement on the track, the rail has opposite fore and aft ends and has fore and aft stops secured to the fore and aft rail ends, respectively;

the track has opposite fore and aft ends, the fore stop of the rail engages the fore end of the track to stop rearward sliding movement of the rail on the track and the aft stop of the rail engages the aft end of the track to stop forward sliding movement of the rail on the track, and dimensions of the slot in the rail cause the fore end of the rail to move in a downward direction and the aft end of the rail to move in an upward direction as the rail slides forward on the track, and the upward movement of the rail aft end positions the rail aft stop for engagement with the track aft end.

* * * * *